US006220236B1

(12) United States Patent
Dillard

(10) Patent No.: US 6,220,236 B1
(45) Date of Patent: Apr. 24, 2001

(54) BALL DELIVERY SYSTEM

(76) Inventor: Jack P. Dillard, 14619 Ella Blvd., Apt. 1602, Houston, TX (US) 77014

( * ) Notice: Subject to any disclaimer, the term of this patent is extended or adjusted under 35 U.S.C. 154(b) by 0 days.

(21) Appl. No.: 08/987,254

(22) Filed: Dec. 9, 1997

(51) Int. Cl.[7] ..... F41B 3/04
(52) U.S. Cl. ..... 124/16; 124/36
(58) Field of Search ..... 124/16, 36

(56) References Cited

U.S. PATENT DOCUMENTS 4,209,004 * 6/1980 Kennedy ..... 124/16 X
4,254,755 * 3/1981 Morgan et al. ..... 124/16
5,619,977 * 4/1997 Gatin ..... 124/16 X

FOREIGN PATENT DOCUMENTS

1433452 * 2/1966 (FR) ..... 124/16

* cited by examiner

*Primary Examiner*—John A. Ricci

(57) ABSTRACT

A ball delivery system including a base member comprising an angularly disposed panel. The angularly disposed panel has an elongated recess extending inwardly from a lower end thereof. A plurality of ball holders are secured to the angularly disposed panel of the base member disposed on opposing long sides of the elongated recess. The plurality of ball holders are dimensioned for channeling a ball therebetween disposed over the elongated recess. A dispensing mechanism is coupled with respect to the base member for throwing the ball over an upper end of the angularly disposed panel.

5 Claims, 2 Drawing Sheets

BALL DELIVERY SYSTEM

BACKGROUND OF THE INVENTION

1. Field of the Invention

The present invention relates to a ball delivery system and more particularly pertains to delivering balls to allow a batter to practice swinging a baseball bat with a ball delivery system.

2. Description of the Prior Art

The use of pitching machines is known in the prior art. More specifically, pitching machines heretofore devised and utilized for the purpose of delivering baseballs are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,132,214 to Schnurr et al.; U.S. Pat. No. 5,066,010 to Pingston; U.S. Pat. No. 5,160,131 to Leon; U.S. Pat. No. 5,232,218 to Leps; U.S. Pat. No. 5,294,109 to Meade; and U.S. Pat. No. 5,294,109 to Meade.

While these devices fulfill their respective, particular objective and requirements, the aforementioned patents do not describe a ball delivery system for delivering balls to allow a batter to practice swinging a baseball bat.

In this respect, the ball delivery system according to the present invention substantially departs from the conventional concepts and designs of the prior art, and in doing so provides an apparatus primarily developed for the purpose of delivering balls to allow a batter to practice swinging a baseball bat.

Therefore, it can be appreciated that there exists a continuing need for new and improved ball delivery system which can be used for delivering balls to allow a batter to practice swinging a baseball bat. In this regard, the present invention substantially fulfills this need.

SUMMARY OF THE INVENTION

In the view of the foregoing disadvantages inherent in the known types of pitching machines now present in the prior art, the present invention provides an improved ball delivery system. As such, the general purpose of the present invention, which will be described subsequently in greater detail, is to provide a new and improved ball delivery system and method which has all the advantages of the prior art and none of the disadvantages.

To attain this, the present invention essentially comprises a base member comprising a pair of triangular shaped side members positioned in a spaced and parallel relationship. Upper ends of the side members have a handle extending therebetween. Lower ends of the side members have a floor member extending therebetween. The side members have an angularly disposed panel disposed therebetween. The angularly disposed panel has an upper end disposed inwardly of vertical rear edges of the side panels and a lower end disposed inwardly of angled front edges of the side panels. The angularly disposed panel has an elongated recess extending inwardly from the lower end thereof. A plurality of ball holders are secured to the angularly disposed panel of the base member disposed on opposing long sides of the elongated recess. The plurality of ball holders are dimensioned for channeling a ball therebetween disposed over the elongated recess. A dispensing mechanism is coupled with respect to the base member for throwing the ball over the upper end of the angularly disposed panel. The dispensing mechanism includes a lever positioned within the recess of the angularly disposed panel. The lever has a lower end pivotally coupled with the floor member of the base member between a pair of brackets. The lever has a spring secured thereto. The spring has a free end secured to the floor member. The spring biases the lever upwardly towards the upper end of the angularly disposed panel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ball delivery system which has all the advantages of the prior art pitching machines and none of the disadvantages.

It is another object of the present invention to provide a new and improved ball delivery system which may be easily and efficiently manufactured and marketed.

It is a further object of the present invention to provide a new and improved ball delivery system which is of durable and reliable construction.

An even further object of the present invention is to provide a new and improved ball delivery system which is susceptible of a low cost of manufacture with regard to both materials and labor, and which accordingly is then susceptible of low prices of sale to the consuming public, thereby making such a ball delivery system economically available to the buying public.

Even still another object of the present invention is to provide a new and improved ball delivery system for delivering balls to allow a batter to practice swinging a baseball bat.

Lastly, it is an object of the present invention to provide a new and improved ball delivery system including a base member comprising an angularly disposed panel. The angularly disposed panel has an elongated recess extending inwardly from a lower end thereof. A plurality of ball holders are secured to the angularly disposed panel of the base member disposed on opposing long sides of the elongated recess. The plurality of ball holders are dimensioned for channeling a ball therebetween disposed over the elongated recess. A dispensing mechanism is coupled with respect to the base member for throwing the ball over an upper end of the angularly disposed panel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
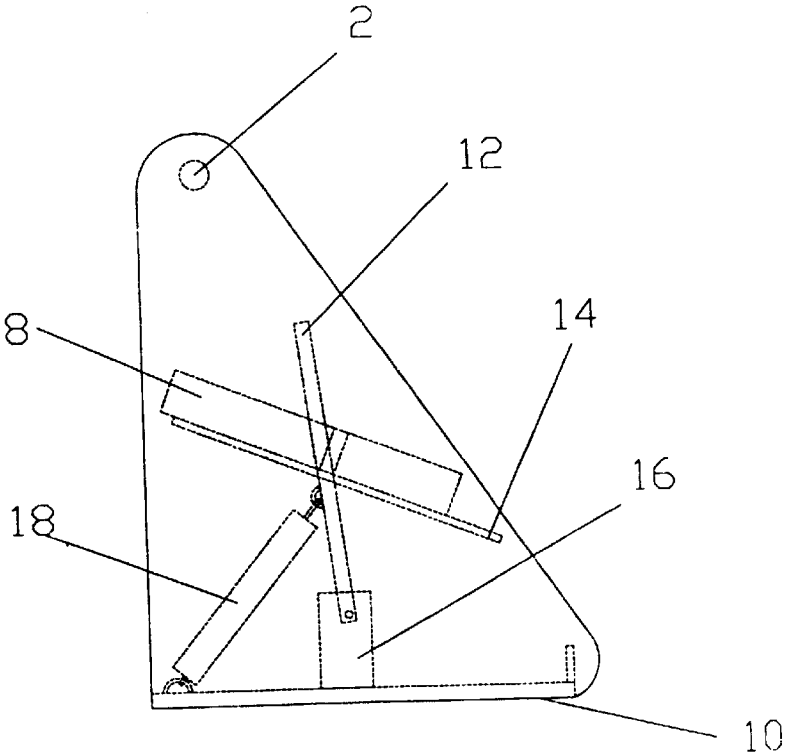
FIG. 2 is a side elevation view of the present invention.
Figure 1:
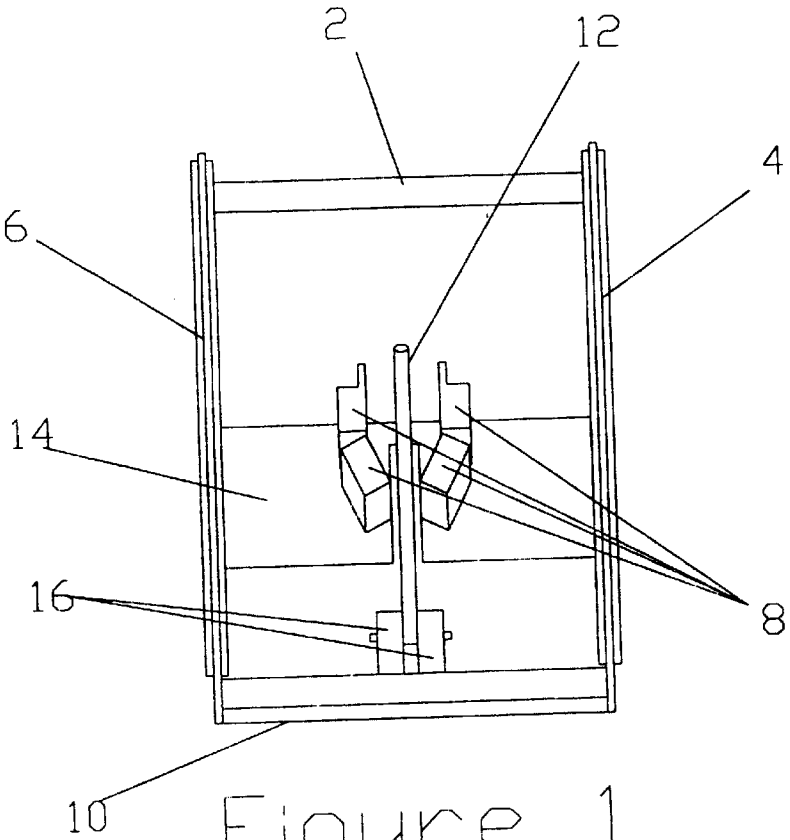
FIG. 1 is a front view of the preferred embodiment of the ball delivery system constructed in accordance with the principles of the present invention.

With reference now to the drawings, and in particular, to FIGS. 1 through 4 thereof, the preferred embodiment of the new and improved ball delivery system embodying the principles and concepts of the present invention.

Specifically, it will be noted in the various Figures that the device relates to a ball delivery system for delivering balls to allow a batter to practice swinging a baseball bat. In its broadest context, the device consists of a base member, a plurality of ball holders and a dispensing mechanism. Such components are individually configured and correlated with respect to each other so as to attain the desired objective.

The base member comprises a pair of triangular shaped side members 4,6 positioned in a spaced and parallel relationship. Upper ends of the side members 4,6 have a handle 2 extending therebetween. Lower ends of the side members 4,6 have a floor member 10 extending therebetween. The side members 4,6 have an angularly disposed panel 14 disposed therebetween. The angularly disposed panel 14 has an upper end disposed inwardly of vertical rear edges of the side panels 4,6 and a lower end disposed inwardly of angled front edges of the side panels 4,6. The angularly disposed panel 14 has an elongated recess extending inwardly from the lower end thereof.

The plurality of ball holders 8 are secured to the angularly disposed panel 14 of the base member, disposed on opposing long sides of the elongated recess. The plurality of ball holders 8 are dimensioned for channeling a ball therebetween disposed over the elongated recess.

The dispensing mechanism is coupled with respect to the base member for throwing the ball over the upper end of the angularly disposed panel 14. The dispensing mechanism includes a lever 12 positioned within the recess of the aingularly disposed panel 14. The lever 12 has a lower end pivotally coupled with the floor member 10 of the base member between a pair of brackets 16. The lever 12 has a spring 18 secured thereto. The spring 18 has a free end secured to the floor member 10. The spring 18 biases the lever 12 upwardly towards the upper end of the angularly disposed panel 14.

To use, the user simply places a ball between the plurality of ball holders 8 and then pulls back on the lever 12 against the resistance of the spring 18. The user then release the lever 12 thereby allowing the spring to bias the lever 12 upwardly through the elongated recess and throwing the ball out over the upper end of the angularly disposed panel 14 to an awaiting batter.

Figure 3:
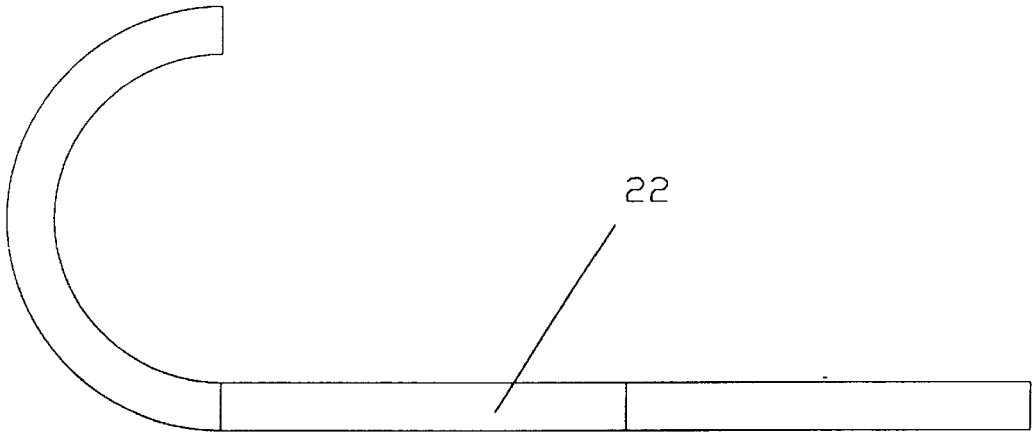
FIG. 3 is a side view of an optional attachment for delivery of the present invention.

In an alternate embodiment, as illustrated in FIG. 3, a J-shaped delivery tube 22 is provided. The J-shaped delivery tube 22 has a linear portion secured to the upper end of the angularly disposed panel 14 for receiving a thrown ball therein. A curved portion of the J-shaped delivery tube 22 dispenses the thrown ball outwardly thereof in an opposite direction from standard operation detailed above.

Figure 4:
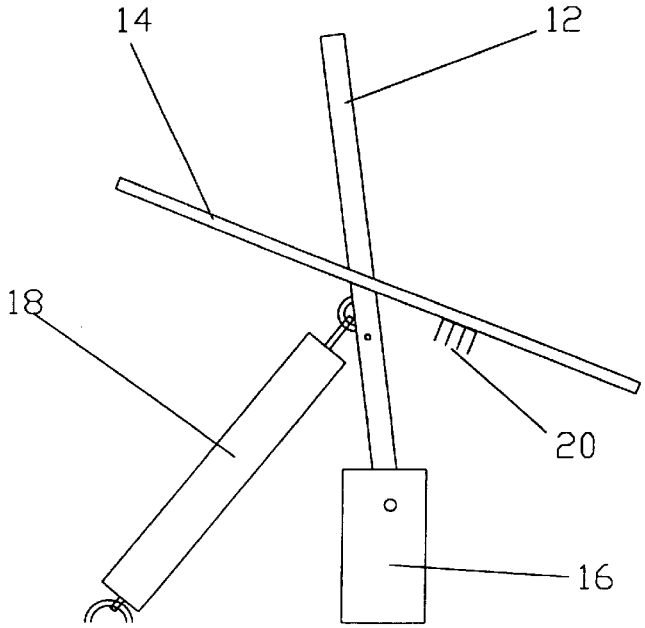
FIG. 4 is a side view of the present invention with an optional delay mechanism coupled thereto.

In another alternate embodiment, as illustrated in FIG. 4, a delay gear 20 is coupled to the lever. The delay gear 20 will engage the lever 12 once pulled back and delay the retraction of the spring 18 to allow the user to get into position as a batter. This embodiment would be optimal for one person usage.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A ball delivery system for delivering balls to allow a batter to practice swinging a baseball bat comprising, in combination;

a base member comprising a pair of triangular shaped side members positioned in a spaced and parallel relationship, upper ends of the side members having a handle extending therebetween, lower ends of the side members having a floor member extending therebetween, the side members having an angularly disposed panel disposed therebetween, the angularly disposed panel having an upper end disposed inwardly of vertical rear edges of the side panels and a lower end disposed inwardly of angled front edges of the side panels, the angularly disposed panel having an elongated recess extending inwardly from the lower end thereof;

a plurality of ball holders secured to the angularly disposed panel of the base member disposed on opposing long sides of the elongated recess, the plurality of ball holders dimensioned for channeling a ball therebetween disposed over the elongated recess;

a dispensing mechanism coupled with respect to the base member for throwing the ball over the upper end of the angularly disposed panel, the dispensing mechanism including a lever positioned within the recess of the angularly disposed panel, the lever having a lower end pivotally coupled with the floor member of the base member between a pair of brackets, the lever having a spring secured thereto, the spring having a free end secured to the floor member, the spring biasing the lever upwardly towards the upper end of the angularly disposed panel.

2. The ball delivery system as set forth in claim 1 and further including a delay gear coupled to the lever.

3. The ball delivery system as set forth in claim 1 and further including a J-shaped delivery tube, the J-shaped delivery tube having a linear portion secured to the upper end of the angularly disposed panel for receiving a thrown ball therein, a curved portion of the J-shaped delivery tube dispensing the thrown ball outwardly thereof in an opposite direction.

4. A ball delivery system for delivering balls to allow a batter to practice swinging a baseball bat comprising, in combination:

a base member having a floor member with an angularly disposed panel fixed relative thereto, the angularly disposed panel having an elan sated recess extending inwardly from a lower end thereof;

a plurality of ball holders secured to an upper surface of said angularly disposed panel on opposing long sides of the elongated recess;

a dispensing mechanism for throwing balls over an upper end of the angularly disposed pane, said dispensing mechanism including a lever positioned within the recess of the angularly disposed panel, the lever having a lower end pivotally coupled between a pair of brackets fixed to said floor member, spring means having one end secured to said floor member and the other end secured to said lever, said spring biasing the lever upwardly towards the upper end of the angularly disposed panel.

5. The ball delivery system as set forth in claim 4 wherein the base member comprises a pair of triangular shaped side members positioned in a spaced and parallel relationship, upper ends of the side members having a handled extending therebetween, lower ends of the side members having a floor member extending therebetween, the side members having the angularly disposed panel disposed therebetween, the angularly disposed panel having an upper end disposed inwardly of vertical rear edges of the side panels and a lower end disposed inwardly of angled front edges of the side panels.

* * * * *